United States Patent [19]

Watanabe

[11] Patent Number: 4,695,151

[45] Date of Patent: Sep. 22, 1987

[54] IMAGE FORMING APPARATUS

[75] Inventor: Junji Watanabe, Yokohama, Japan

[73] Assignee: Kabushiki Kaisha Toshiba, Kawasaki, Japan

[21] Appl. No.: 788,724

[22] Filed: Oct. 17, 1985

[30] Foreign Application Priority Data

Oct. 26, 1984 [JP] Japan ..... 59-225308

[51] Int. Cl.[4] ..... G03G 15/00; G03G 15/12

[52] U.S. Cl. ..... 355/3 R; 355/30

[58] Field of Search ..... 355/3 R, 15, 11, 3 SC, 355/3 DD, 30, 3 FU

[56] References Cited

U.S. PATENT DOCUMENTS 3,332,328 7/1967 Roth ..... 355/3 R
3,561,868 2/1971 Ritzerfeld ..... 355/30 X
3,914,046 10/1975 Tanaka et al. ..... 355/3 DD
4,025,180 5/1977 Kurita et al. ..... 355/3 R
4,178,092 12/1979 Yamamoto et al. ..... 355/3 CH
4,530,589 7/1985 Adams ..... 355/30 X

*Primary Examiner*—R. L. Moses
*Attorney, Agent, or Firm*—Oblon, Fisher, Spivak, McClelland, & Maier

[57] ABSTRACT

In an image forming apparatus, an original placed on an exposure table is illuminated for exposure to form an image. The image forming apparatus comprises an optical unit including a light source for exposing the original and a ventilating unit for ventilating the optical unit. The ventilating unit is provided with a fan, a first duct for guiding and discharging air from the fan to the outside of the apparatus, and a second duct for guiding part of the air from the fan so as to drive it back into the optical unit.

10 Claims, 8 Drawing Figures

IMAGE FORMING APPARATUS

BACKGROUND OF THE INVENTION

The present invention relates to an image forming apparatus for forming an image in accordance with image information from an original placed on an exposure table.

As shown in FIG. 1, an image forming apparatus of this type is provided with an optical unit 3 which illuminates an original placed on an exposure table 1 to scan the same, and directs reflected light from the original to a photosensitive drum 2. The optical unit 3 includes a lamp 4 moving along the exposure table 1 to illuminate the original, and mirrors 5 and 6 and a lens unit 7 for directing the reflected light from the original to the photosensitive drum 2.

The optical unit 3 is provided with a fan 8 for discharging air in the unit 3 to the outside of the apparatus in order to prevent the temperature inside the unit 3 from being increased by heat from the lamp 4. Meanwhile, a relatively wide space is defined inside the optical unit 3 to allow the lamp 4 and the mirrors 5 to move along the exposure table 1.

In the prior art image forming apparatus, the fan 8 is located at one side portion of a housing 9 of the apparatus, underlying the optical unit 3. The fan 8 used the prior case is a line-flow fan. However, the space for the optical unit 8 is too wide to be ventilated efficiently. In other words, it is impossible to effectively discharge air from the optical unit 8 and introduce fresh air from the outside into the unit 8. Unavoidably, therefore, the efficiency of cooling the interior of the optical unit 3 is low.

SUMMARY OF THE INVENTION

The present invention is contrived in consideration of these circumstances, and is intended to provide an image forming apparatus permitting high-efficiency cooling of the optical unit.

According to an aspect of the present invention, there is provided an image forming apparatus which illuminates an original for exposure to form an image corresponding to reflected light from the original, comprising an exposure table to carry the original thereon, an optical unit for exposing the original on the exposure table, the optical unit including a light source, and ventilating means for ventilating the interior of the optical unit to cool the same, the ventilating means including a fan, first duct means for guiding air from the fan to the outside of the optical unit, and second duct means for returning part of the air from the fan to the optical unit.

DETAILED DESCRIPTION OF THE PREFERRED EMBODIMENTS

Several embodiments of the present invention will now be described in detail with reference to the accompanying drawings of FIGS. 2 to 8.

Figure 1:
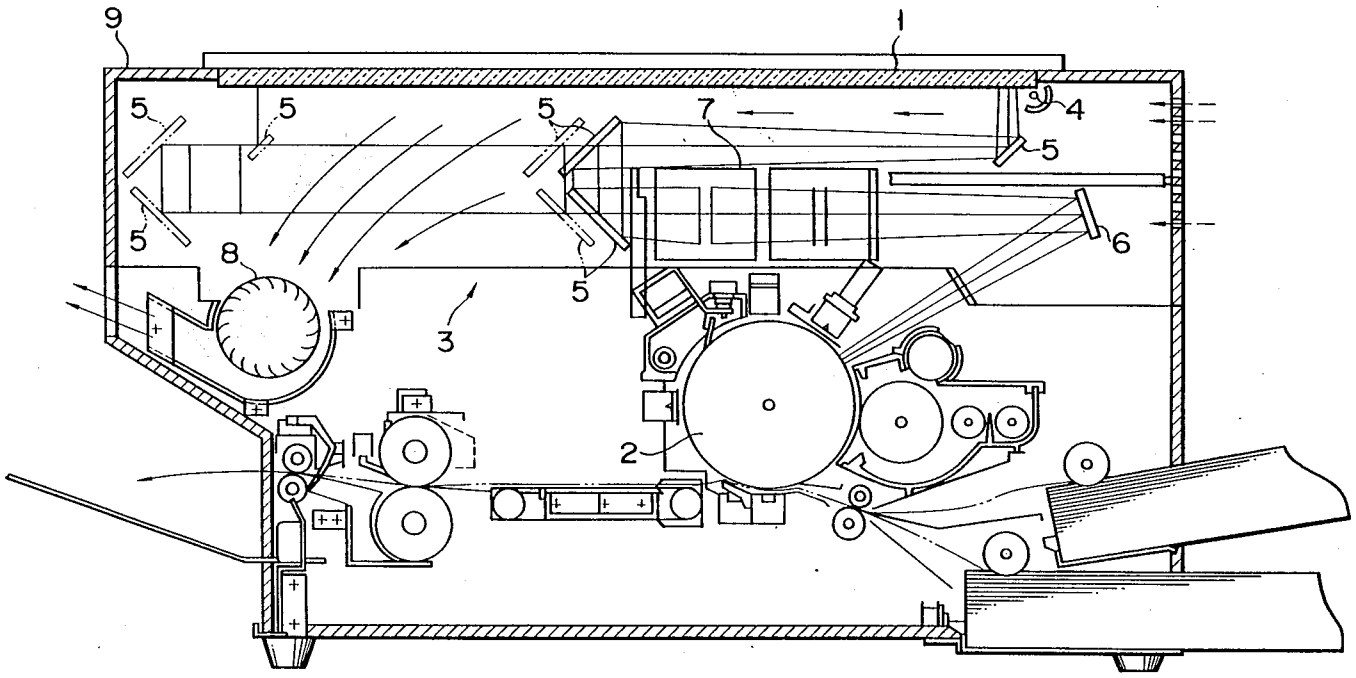
FIG. 1 PRIOR ART
FIG. 1 is a schematic vertical sectional view of a prior art image forming apparatus.
Figure 2:
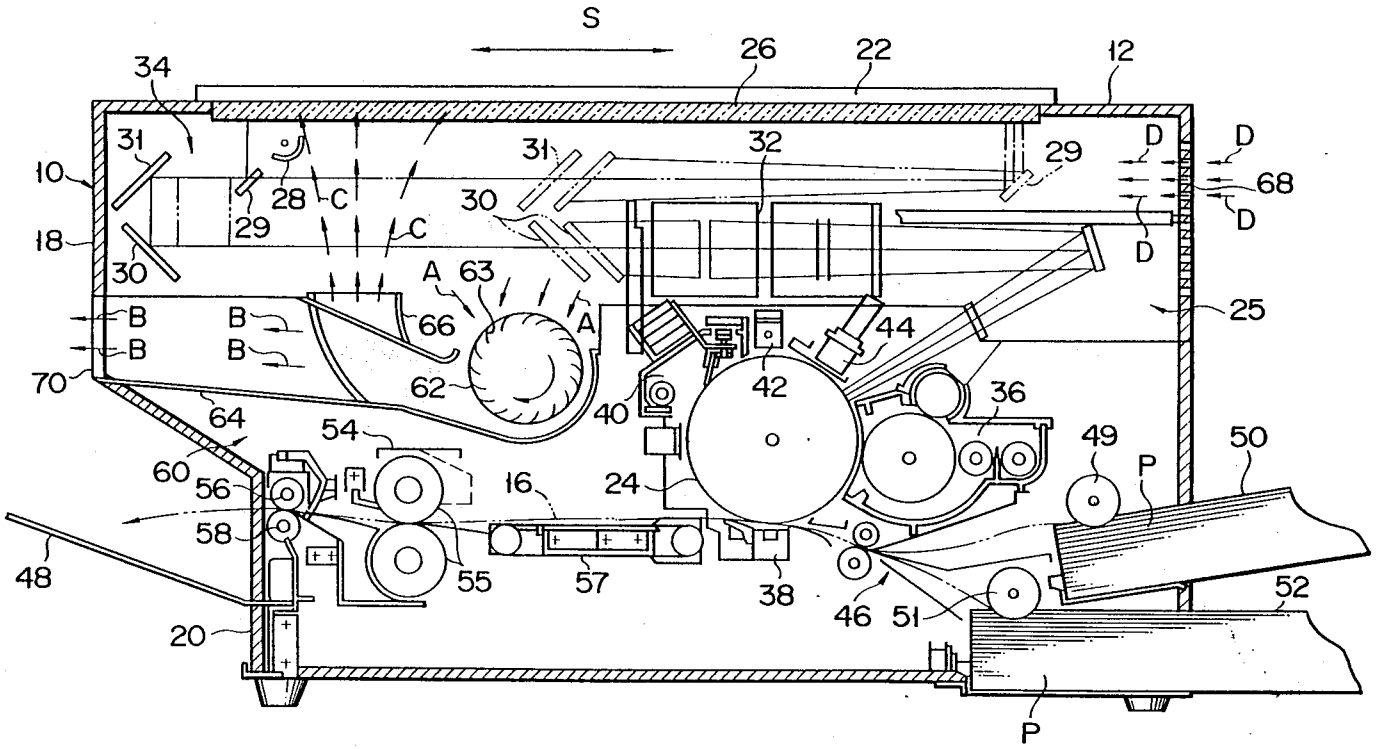
FIG. 2 is a schematic vertical sectional view of an image forming apparatus according to a first embodiment of the present invention.
Figure 3:
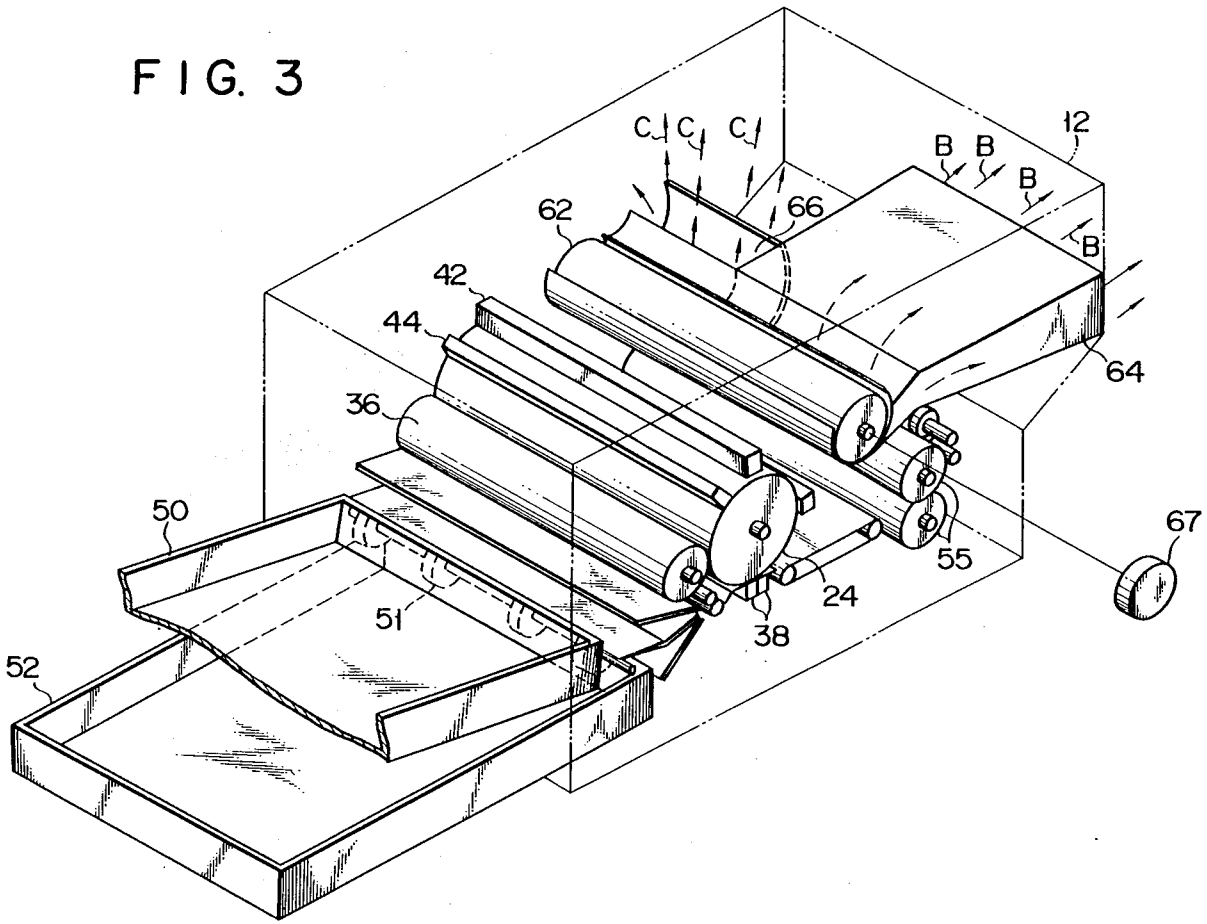
FIG. 3 is a perspective view schematically showing the principal part of the image forming apparatus of FIG. 2.

As shown in FIGS. 2 and 3, a copying machine 10 according to a first embodiment of the present invention comprises a body 12 which is divided into two sections, i.e., upper and lower units 18 and 20, with respect to a transfer path 16, as indicated by a double dotted line, along which paper sheets P are transported. A cover 22 for immovably holding an original (not shown), as set for copy, is mounted on the top of the body 12 in a hinged manner, for example. A photosensitive drum 24 is rotatably situated substantially in the center of the body 12. When the photosensitive drum 24 is illuminated with light containing image information, a latent image is formed on its surface. An exposure table 26 on which the original is placed is situated between the photosensitive drum 24 and the cover 22.

Located between the exposure table 26 and the photosensitive drum 24 is an optical unit 25 including a scanning unit or exposure unit 27 which moves in the direction of double-headed arrow S to optically scan the original on the exposure table 26. The scanning unit 27 is provided with an exposure lamp 28 and a first mirror 29 for reflecting light coming from the exposure table 26. An optical path system 34 is further provided in the optical unit 25 for directing the light from the first mirror 29 toward the photosensitive drum 24. The optical path system 34 includes second mirrors 30 and 31 and a lens unit 32, which constitute a magnification setting means and are movable in the direction indicated by arrow S. The scanning unit 27 and the photosensitive drum 24 are provided with a drive mechanism (not shown). In the exposure process of a copying cycle, the drive mechanism drives the scanning unit 27 and the photosensitive drum 24. The moving and rotating speeds of the scanning unit 27 and the photosensitive drum 24 depend on the magnification to be set.

A developing unit 36, a transfer unit 38, a cleaning unit 40, a quenching unit 42, and a charger 44 are successively arranged around and close to the outer periphery of the photosensitive drum 24, circumferentially spaced from one another. The developing unit 36 applies toner particles to the surface of the photosensitive drum 24 to develop an electrostatic latent image formed thereon. The transfer unit 38 transfers the toner image to a sheet of paper. The cleaning unit 40 removes the toner particles on the photosensitive drum 24 to clean the drum surface. The quenching unit 42 quenches the latent image on the drum surface. The charger 44 charges the drum surface.

The transfer path 16 begins with a sheet feeder 46 at the right end of the lower unit 20 as viewed in the drawing and terminates at a paper tray 48 at the other end of the unit 20. The sheet feeder 46 is designed so as to receive cassettes 50 and 52 which contain sheets of paper P. Feed rollers 49 and 51 are provided in association with the cassettes 50 and 52, respectively, to feed the sheets P, one by one, to an aligning roller pair 53. The aligning roller pair 53, which is situated between the sheet feeder 46 and the photosensitive drum 24, aligns the leading edge of the sheet of paper P, as fed from the sheet feeder 46, and feeds the sheet P toward the photosensitive drum 24. A transport section 57, which is disposed between the photosensitive drum 24 and a fixing or fusing unit 54, delivers the sheet P fed from the photosensitive drum 24 to the fixing unit 54. Arranged at the end portion of the transfer path 16 are the fixing unit 54, including a pair of fixing rollers 55, and a pair of exit rollers 56 and 58. The fixing rollers 55 serve to fuse toner particles of the toner image on the sheet P.

The upper unit 18 is provided with a ventilating unit 60 for preventing increase of the temperature inside the optical unit 26 in which the exposure lamp 28 generates heat. The ventilating unit 60 includes a cross-flow fan 62 extending at right angles to the scanning directions of the scanning unit 27 and first and second ducts 64 and 66 for guiding air from the cross-flow fan 62. Located substantially in the center of the body 12 and under the optical unit 25 so as to be within the range of the stroke of the exposure unit 27, the cross-flow fan 62 is driven by a motor 67 to take in air from the optical unit 25. Corresponding to the optical unit 25, an inlet port 68 and an exhaust port 70 are formed in the flank of the body 12. These ventilating holes 68 and 70 face each other with the ventilating unit 60 between them. The fan 62 is substantially cylindrical and has a plurality of longitudinally extending blades 63 with an arcuate section. One end of the cross-flow fan 62 is coupled to a motor 67 to be driven thereby. The fan 62, which has a hollow structure, can provide a greater quantity of air with less noise than a propeller type fan can. Having an elongated cylindrical shape, moreover, the fan 62 requires less space. Further, the ventilating unit 60 is provided substantially in the center of the body 12. Thus, the noise of the ventilating unit 60 is insulated from going out of the body 12 through the ventilating holes.

As shown in FIG. 3, the first duct 64 is disposed so as to cover substantially half the length of cross-flow fan 62, and guides air from the fan 62 toward the exhaust port 70. The second duct 66 corresponds to the other half of the cross-flow fan 62, and guides the air from the fan 62 toward the exposure table 26. In this case, the air in the second duct 66 blown toward the exposure table 26 causes a forced flow in the air in the optical unit 25.

The operation of the copy machine according to the first embodiment will now be described. In the image forming process, the original on the exposure table 26 is scanned by the optical path system 34, and reflected light from the original is applied to the photosensitive drum 24 through the mirrors 30 and 31 and the lens unit 32. The exposure lamp 28 and the scanning mirror (first mirror) 29 scan the original on the exposure table 22 at a predetermined speed. The second mirrors 30 and 31 reciprocate in synchronism with the rotation of the photosensitive drum 24, moving at a speed half that of the scanning mirror 29 so as to keep the optical path length constant.

By the illumination of the photosensitive drum 24, an electrostatic latent image corresponding to an image of the original is formed on the surface of the drum 24 charged by the charger 44. The electrostatic latent image is delivered to the developing unit 36 to be supplied thereby with a developing agent. After the latent image is developed into a visible image in this manner, the developed image is delivered to the transfer unit 38. Meanwhile, the sheet P is fed from the sheet feeder 46 to the photosensitive drum 24. In this case, the sheet P from the cassette 50 or 52 is delivered to the space between the photosensitive drum 24 and the transfer unit 38, where the image on the drum 24 is transferred to the sheet P. Thereafter, the sheet P is fed to the fixing unit 54 for fixing the image, and then discharged into the paper tray 48 by the exit rollers 56 and 58.

Those toner particles remaining on the photosensitive drum 24, having not been transferred to the sheet P, are removed by the cleaning unit 40, and the surface of the drum 24 cleared of the residual toner particles is de-electrified by the quenching unit 42 to provide for the next copying cycle.

The flow of air in the optical unit 25 produced by the ventilating unit 60 will now be described. As the cross-flow fan 62 is driven, the warmed air in the optical unit 25 is taken in by the fan 62, as indicated by arrows A in FIG. 2. About half the air introduced into the fan 62 is guided into the first duct 64, as indicated by arrows B, and discharged from the body 12 through the exhaust port 70. The remaining half of the air in the fan 62 is led into the second duct 66, and blown against the exposure table 26, as indicated by arrows C. In the meantime, cool air outside the body 12 flows into the optical unit 25 through the inlet port 68. According to this embodiment, the air in the optical unit 25 is blown directly against the exposure table 26, so that the exposure table 26 can enjoy an improved cooling effect.

According to this embodiment, moreover, the air is circulated in the optical unit 25 by convection and impelled by forced-ventilation, so that the interior of the unit 25 can be cooled efficiently.

Referring now to FIGS. 4 to 8, alternative embodiments of the present invention will now be described in detail. In the description to follow, like portions as included in the first embodiment are designated by like reference numerals, and a detailed description thereof is omitted.

Figure 4:
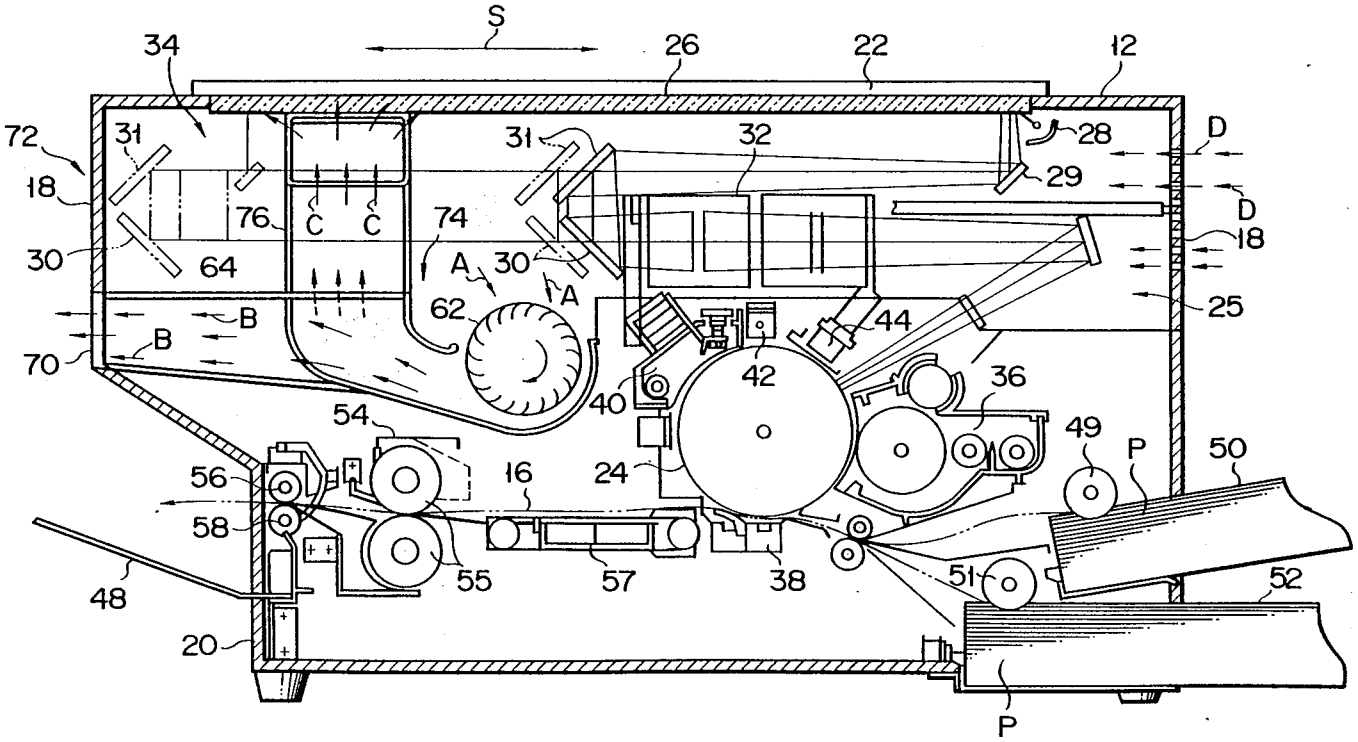
FIG. 4 is a schematic vertical sectional view of an image forming apparatus according to a second embodiment of the invention.
Figure 5:
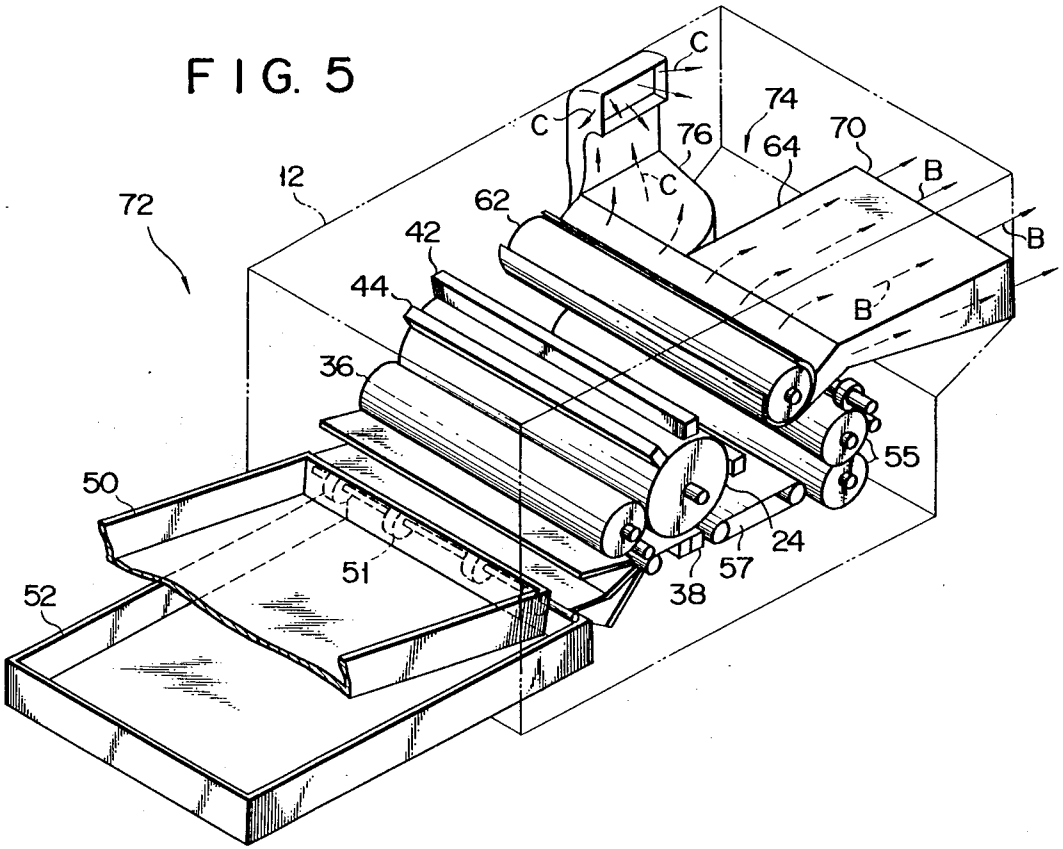
FIG. 5 is a perspective view schematically showing the principal part of the image forming apparatus of FIG. 4.

FIGS. 4 and 5 show a copy machine 72 according to a second embodiment of the invention. As in the first embodiment, a ventilating unit 74 of the copy machine 72 of the second embodiment is provided with a cross-flow fan 62 and a first duct 64 for directing air from the cross-flow fan 62 to an exhaust port 70 formed in a body 12. The ventilating unit 74 is further provided with a second duct 76 for feeding part of the air from the cross-flow fan 62 into an optical unit 25. Substantially L-shaped, the second duct 76 extends upward from the cross-flow fan 62 so that its open end is directed parallel to an exposure table 26 and along the axis of a photosensitive drum 24. According to this second embodiment, the second duct 76 allows part of the air from the cross-flow fan 62 to flow along the exposure table 26 so that the air in the optical unit 25 is circulated by forced convection. Thus, the exposure table 26 and the inside of the optical unit 25 can effectively be cooled.

Figure 6:
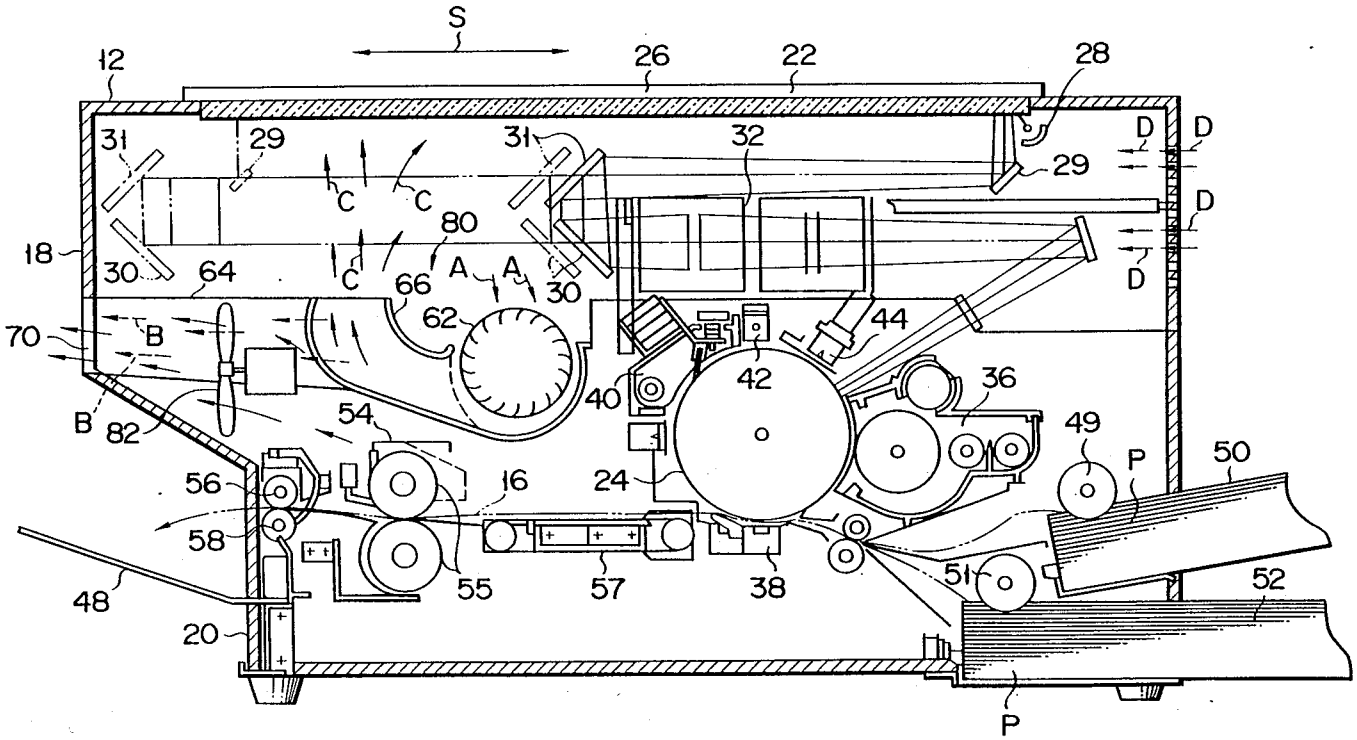
FIG. 6 is a schematic vertical sectional view of an image forming apparatus according to a third embodiment of the invention.

FIG. 6 shows a copy machine 78 according to a third embodiment of the invention. A ventilating unit 80 of the copy machine 78 of the third embodiment is additionally provided with a propeller fan 82, besides the provisions of the first embodiment. The propeller fan 82 is disposed between an exhaust port 70 and a second duct 66, adjoining a first duct 64. The propeller fan 82 serves to discharge heat generated by a fixing unit 54 to the outside through the exhaust port 70. According to this third embodiment, the propeller fan 82 is situated in a space defined by the first and second ducts 64 and 66, so that the discharge of the heat from the fixing unit 54 can be accomplished with effective utilization of space. Thus, according to the third embodiment, the interior of the optical unit 25 and the space around the fixing unit 54 can be cooled with high efficiency.

Figure 7:
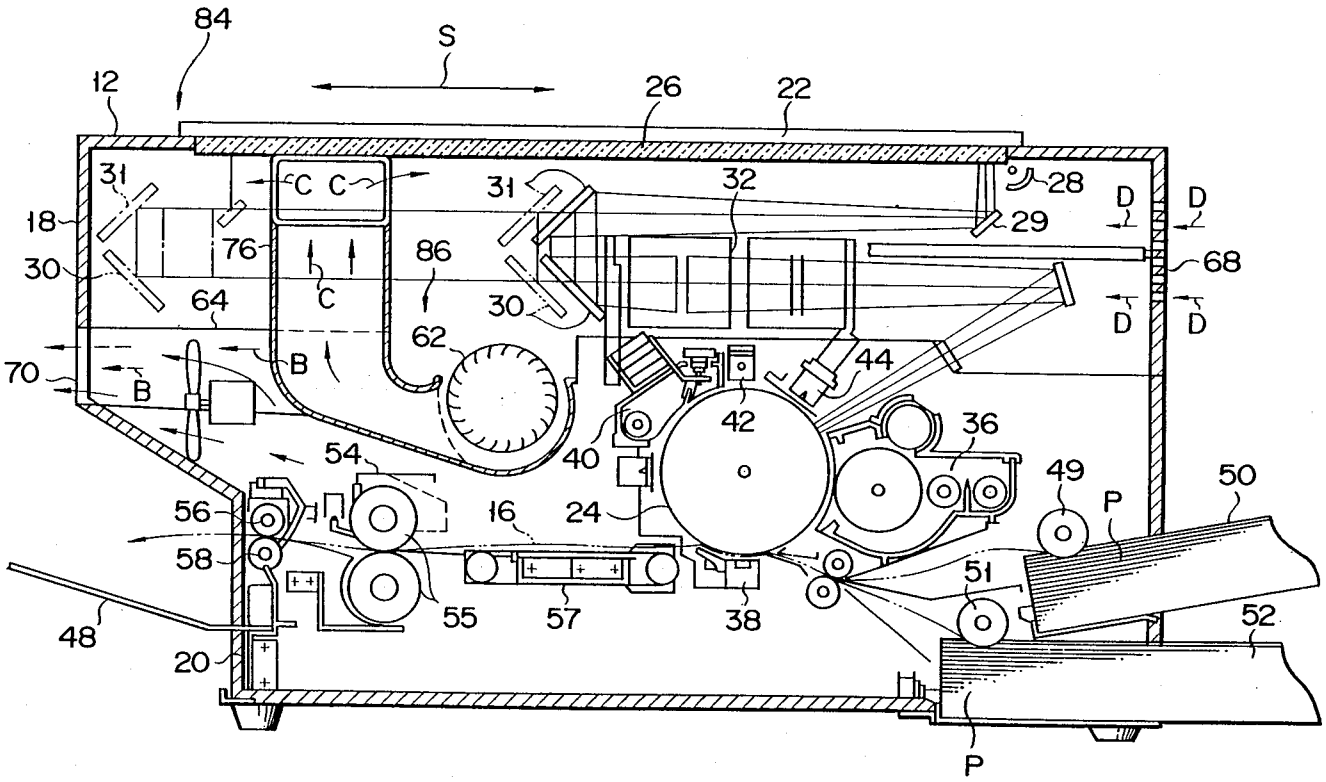
FIG. 7 is a schematic vertical sectional view of an image forming apparatus according to a fourth embodiment of the invention.

FIG. 7 shows a copy machine 84 according to a fourth embodiment of the invention. A ventilating unit 86 of the copy machine 84 is additionally provided with a propeller fan 82, besides the provisions of the second embodiment. Like that of the third embodiment, the propeller fan 82 is situated in a space defined between first and second ducts 64 and 76, and serves to discharge heat generated by a fixing unit 54. The fourth embodiment can provide the same effects of the third embodiment.

Figure 8:
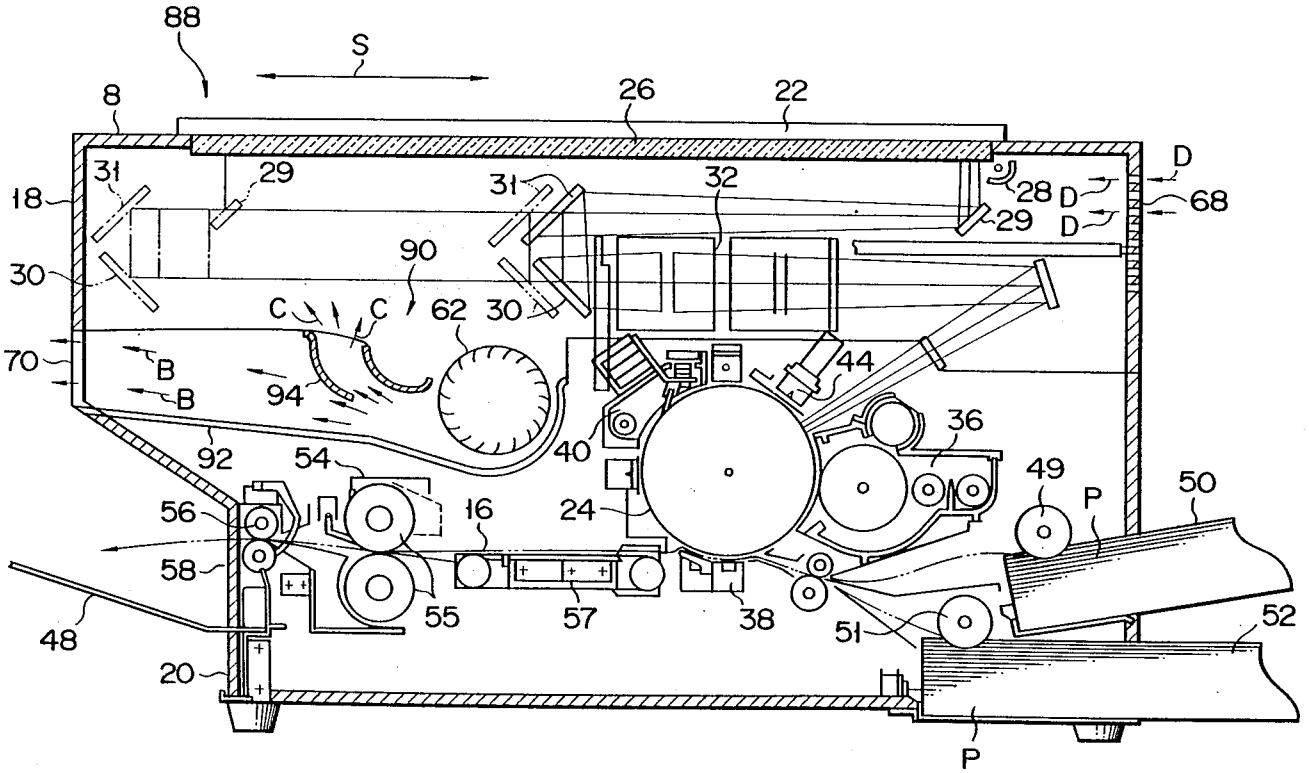
FIG. 8 is a schematic vertical sectional view of an image forming apparatus according to a fifth embodiment of the invention.

FIG. 8 shows a copy machine 88 according to a fifth embodiment of the invention. In a ventilating unit 90 of the copy machine 88, first and second ducts are formed integrally. Namely, the ventilating unit 90 includes a duct 92 which extends from a cross-flow fan 62 and an exhaust port 70. The duct 92 has a width covering the whole axial length of the cross-flow fan 62. The duct 92 is provided with a separating plate 94 which extends from the top of the duct 92 to its central portion and guides part of the airflow in the duct 92 toward the exposure table 26. According to this fifth embodiment, essentially the single duct 92 can carry air in two directions, providing the same effects of the first embodiment in spite of the simpler construction.

It is to be understood that the present invention is not limited to the embodiments described above, and that various changes and modifications may be effected therein by one skilled in the art without departing from the scope or spirit of the invention.

In the above embodiments, for example, the cross-flow fan is used for the ventilating fan. It may, however, be replaced with a sirocco fan or propeller fan.

In the above embodiments, moreover, the cross-flow fan is described as extending parallel to the axis of the photosensitive drum. It may, however, be positioned so as to extend in any other direction.

Although illustrative embodiments of the present invention have been described as being applied to copy machines provided integrally with a photosensitive drum, the invention may also be applied to, for example, optical character reading machines which read the original by exposure and deliver information signals indicative of an image of the original.

What is claimed is:

1. An image forming apparatus which illuminates an original for exposure to form an image corresponding to reflected light from the original, comprising:

an exposure table to carry the original thereon;

an optical unit for exposing the original on the exposure table, said optical unit including a light source;

ventilating means for ventilating the interior of the optical unit, said ventilating means including a first fan, first duct means for guiding air from the first fan to the outside of the optical unit, and second duct means for returning part of the air from the first fan to the optical unit; and a photosensitive drum adapted to be illuminated with the reflected light from the original to form thereon a latent image corresponding to the image of the original, wherein said first fan has an axial dimension substantially equal to the longitudinal dimension of the photosensitive drum.

2. An apparatus according to claim 1, wherein said first fan is a cross-flow fan.

3. An apparatus according to claim 1, wherein said first fan is located under the optical unit and substantially in the center of the housing of the apparatus.

4. An apparatus according to claim 1, wherein said second duct means includes a duct for guiding the air from the first fan so as to blow against the exposure table.

5. An apparatus according to claim 1, wherein said second duct means includes a duct extending from the first fan to the exposure table and having an opening through which the air is discharged to flow along the surface of the exposure table.

6. An apparatus according to claim 1, wherein said first and second duct means are formed integrally, said second duct means including a partition wall formed at the middle portion of the first duct means.

7. An image forming apparatus which illuminates an original for exposure to form an image corresponding to reflected light from the original, comprising:

an exposure table to carry the original thereon;

an optical unit for exposing the original on the exposure table, said optical unit including a light source; and ventilating means for ventilating the interior of the optical unit, said ventilating means including a cross-flow fan, first duct means for guiding air from the first fan to the outside of the optical unit, and second duct means for returning part of the air from the first fan to the optical unit;

wherein said first duct means corresponds in position to one half of the cross-flow fan as viewed along the longitudinal direction thereof, and said second duct means corresponds to the other half.

8. An apparatus according to claim 7, wherein said ventilating means further includes a second fan for ventilating any other portion of the apparatus than the optical unit.

9. An apparatus according to claim 8, wherein said second fan is a propeller fan.

10. An apparatus according to claim 8, wherein said second fan is located between the second duct means and the housing of the apparatus so as to adjoin the first duct means.

* * * * *